United States Patent [19]

Itoh

[11] 4,227,652

[45] Oct. 14, 1980

[54] POWDER CHARGING DEVICE

[75] Inventor: Tsutomu Itoh, Tokyo, Japan

[73] Assignee: Onoda Cement Co., Ltd., Onoda, Japan

[21] Appl. No.: 35,476

[22] Filed: May 3, 1979

[30] Foreign Application Priority Data

May 9, 1978 [JP] Japan ..... 53/54701

[51] Int. Cl.[3] ..... B05B 5/02

[52] U.S. Cl. ..... 239/706; 239/105; 361/226

[58] Field of Search ..... 239/3, 105, 690–708; 361/218, 226, 227

[56] References Cited

U.S. PATENT DOCUMENTS

| | | | |
|---|---|---|---|
| 3,630,441 | 12/1971 | Felici et al. | 239/692 |
| 3,951,340 | 4/1976 | Point | 239/707 X |
| 3,964,683 | 6/1976 | Gimple | 239/105 X |
| 4,009,829 | 3/1977 | Sickles | 239/705 |
| 4,020,393 | 4/1977 | Porter | 239/707 X |
| 4,039,145 | 8/1977 | Felici et al. | 239/706 |

*Primary Examiner*—Robert W. Saifer

*Attorney, Agent, or Firm*—Price, Heneveld, Huizenga & Cooper

[57] ABSTRACT

On the downstream side of a large-diameter cylindrical flow path is disposed a small-diameter cylindrical flow path having a smaller inner diameter than the inner diameter of the large-diameter cylindrical flow path contiguously to the large-diameter cylindrical flow path, an annular electrode is disposed at the upstream end of the small-diameter cylindrical flow path, a needle electrode is provided at the center of the annular electrode applying a D.C. high voltage between the electrodes, and upon charging powder contained in a mixed-phase flow through said cylindrical flow paths, a substantial slip velocity is given to the mixed-phase flow adjacent to the surface of the annular electrode.

9 Claims, 9 Drawing Figures

Figure 5:
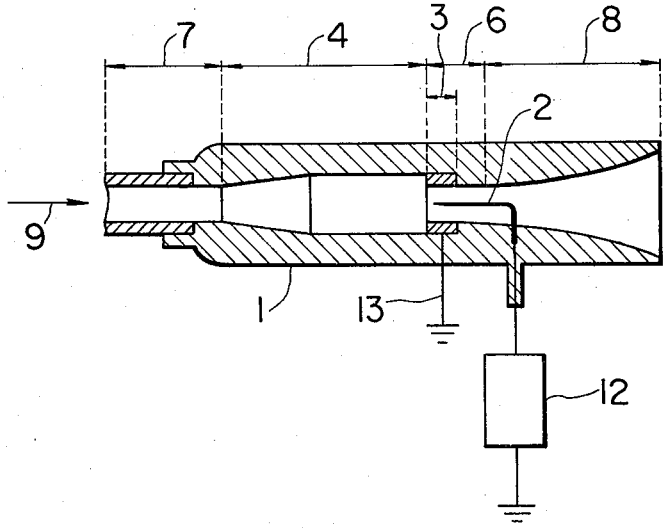

FIG. 1
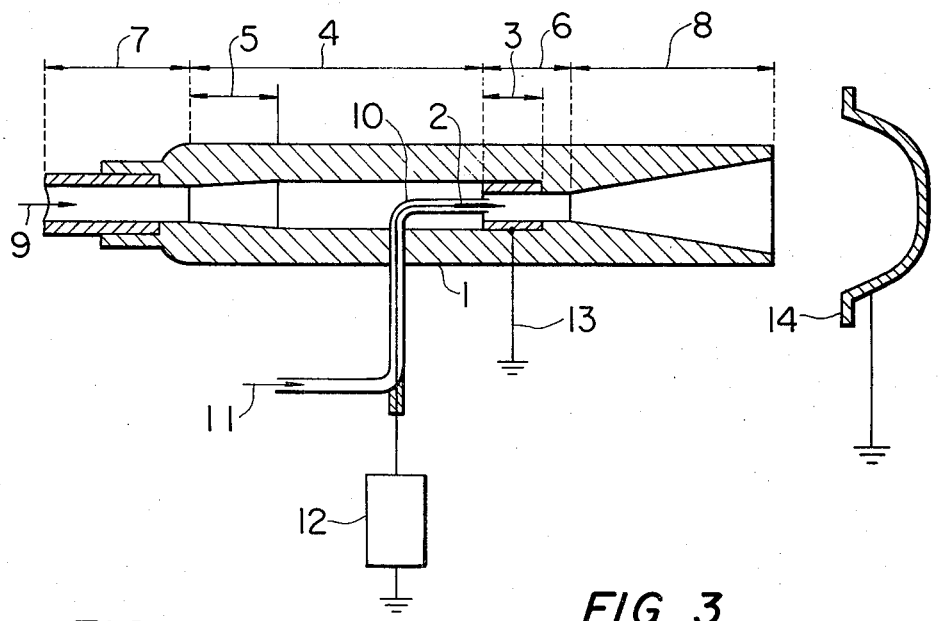
FIG. 2
FIG. 3
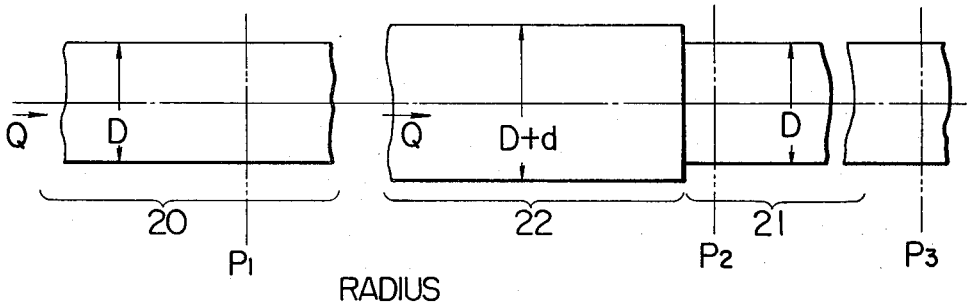
FIG. 4
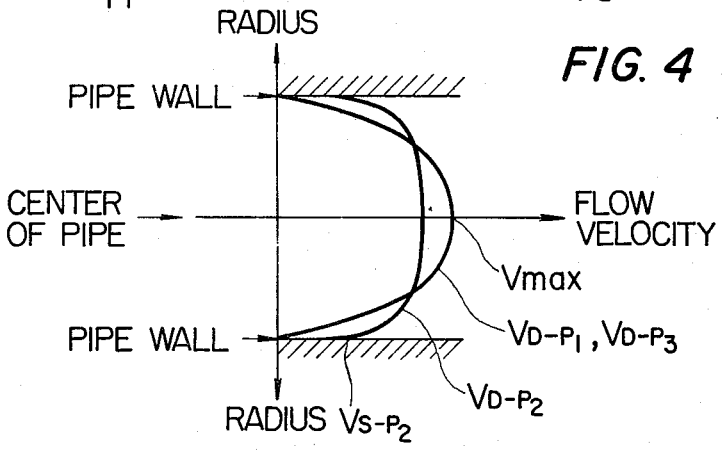

POWDER CHARGING DEVICE

The present invention relates to a charging device for powder carried by a gas, which is compact, simple in structure and of excellent performance, and which is useful for electrostatic powder painting.

In the heretofore known devices for monopolarly charging powder particles such as powder paint carried by a gas for the purpose of electrostatic powder painting or the like, there exists a device in which an annular electrode is disposed on a tubular wall of a flow path of a mixed-phase flow consisting of a gas and powder paint, an needle electrode is disposed at the center of the annular electrode, a D.C. high voltage is applied between these two electrodes, and the powder is charged by a monopolar ion current flowing from the needle to the annular electrode.

However, if such a known device is operated as an industrial device, as an operation time elapses, particles of powder paint accumulate on the surface of the annular electrode and form an electrical insulator layer, and thereby a discharging current from the needle electrode towards the annular electrode is impeded. At the same time, owing to back ionization occurring within the insulator layer, a current of opposite polarity flows in the opposite direction from the surface of the annular electrode towards the acicular electrode, and so, that this inverse current offsets the charg of powder particles by the aforementioned monopolar current from the needle electrode towards the annular electrode.

In order to resolve this problem, a number of proposals have been made. However, every such proposal is to intend to prevent the powder particles from accumulating on the surface of the annular electrode by forming a clean air flow layer along the surface of the electrode separately from the above-mentioned mixed-phase flow. This necessitates a considerably large amount of clean air and results in an extremely high velocity of the powder carrying air at the outlet of the powder charging device. Therefore, in the case of employing this powder charging device as an electrostatic powder painting gun, a blow-out velocity of a powder carrying gas flow at the tip end of the gun becomes extremely fast, and hence it becomes difficult to deposite powder paint onto a body to be painted.

Therefore, it is one object of the present invention to provide a novel powder charging device having a simple structure, which can maintain an excellent performance over a long period of time while holding a flow velocity of the same order as that of a gas/powder mixed-phase flow within a paint feed pipe of the conventional electrostatic powder painting gun, without employing an additional clean gas flow for preventing powder from accumulating and depositing onto a surface of an annular electrode which is a short-coming of the heretofore known powder charging devices as fully described above.

According to one feature of the present invention, there is provided a powder charging device comprising a large-diameter cylindrical flow path, a small-diameter cylindrical flow path having a smaller inner diameter than the inner diameter of said large-diameter cylindrical flow path, an annular electrode disposed at the upstream end of said small-diameter cylindrical flow path, and an needle electrode disposed concentrically with said annular electrode as opposed to each other, said large-diameter cylindrical flow path being disposed contiguously to said small-diameter cylindrical flow path on the upstream side of the latter, and said two electrodes are adapted to be applied with a voltage therebetween.

Figure 6:
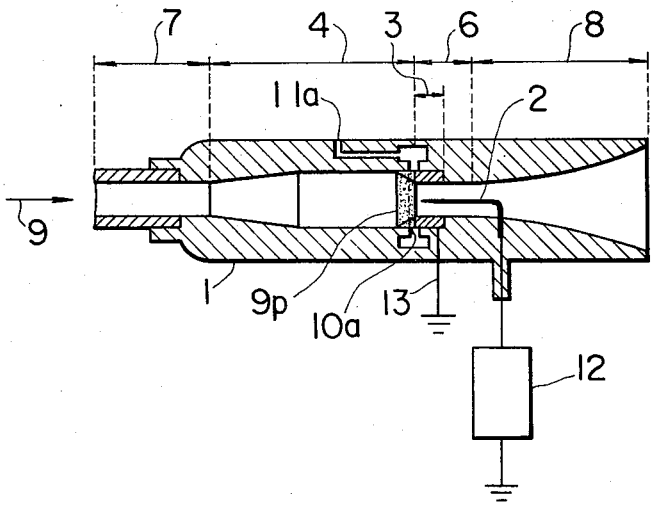
Figure 7:
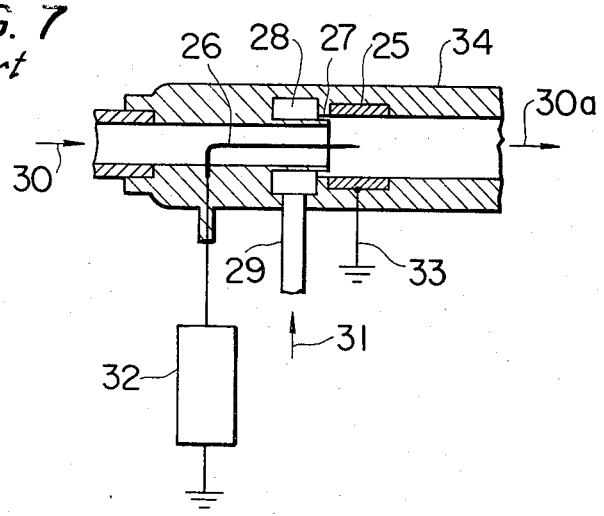
FIG. 7 Prior Art
Figure 8:
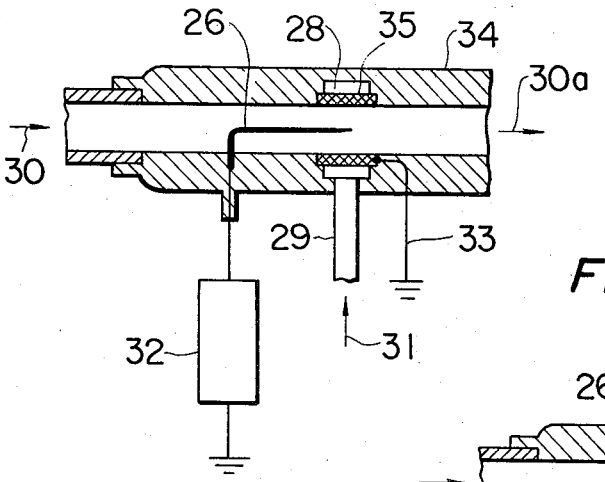
FIG. 8 Prior Art
Figure 9:
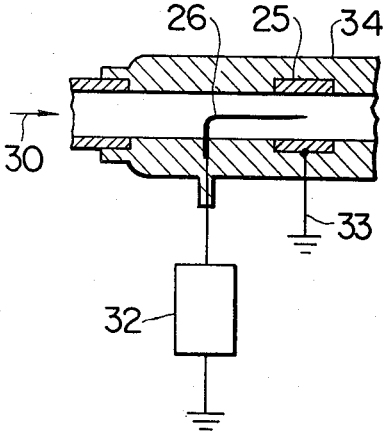
FIG. 9 Prior Art

The above-mentioned and other features and objects of the present invention will become more apparent by reference to the following specification taken in conjunction with the accompanying drawings, wherein:

FIG. 1 is a longitudinal cross-section view of one preferred embodiment of the powder charging device according to the present invention, FIGS. 2, 3 and 4 are diagrammatic views for explaining the principle of the present invention, FIGS. 5 and 6, respectively are cross-section views illustrating other preferred embodiments of the present invention, and FIGS. 7, 8 and 9, respectively are cross-section views illustrating known powder charging devices in the prior art.

Referring now to FIG. 1 of the drawings, a powder charging device 1 according to the present invention is based on the structural feature that the device comprises a small-diameter cylindrical flow path 6, an annular electrode 3 disposed in the proximity of the upstream end of the small-diameter cylindrical flow path 6, an needle electrode 2 disposed concentrically with the annular electrode 3 as opposed to each other, and a large-diameter cylindrical flow path 4 having a larger inner diameter than the inner diameter of the small-diameter cylindrical flow path 6 and disposed contiguously to the small-diameter cylindrical flow path 6 on the upstream side thereof, and a D.C. voltage is applied between the needle electrode 2 and the annular electrode 3 by means of a power supply 12 and a lead 13. In FIG. 1, reference numeral 7 designates a conduit for leading a gas/powder mixed-phase flow 9 to the powder charging device 1, and the flow velocity of the gas/powder mixed-phase flow 9 through this conduit 7 is equal to a transport velocity of a gas/powder mixed-phase flow in a conventional electrostatic powder gun. In other words, a gas/powder mixed-phase flow is supplied to this powder charging device 1 at a flow velocity of about 7 m/sec. to 35 m/sec. In the large-diameter cylindrical flow path 4, an expanding tube section 5 located in the upstream portion is provided for the purpose of smoothly transferring a flow velocity pattern of the gas/powder mixed-phase flow between the conduit 7 and the large diameter cylindrical flow path 4. In the powder charging device 1 according to the present invention, since the flow velocity of the gas/powder mixed phase flow in the portion that is very close to the surface of the annular electrode 3 becomes extremely fast owing to the effect of the large-diameter cylindrical flow path 4 disposed contiguously to and upstream of the annular electrode 3, due to this high velocity mixed-phase flow powder particles can be very effectively prevented from accumulating and depositing onto the surface of the annular electrode 3 over a long period of time, and thereby there is provided a powder charging device having an excellent performance under such inside flow velocity and powder processing rate conditions as normally required for the conventional electrostatic powder painting gun for several tens of hours even in the case of thermo-setting resins having extremely low melting points, and for several hundreds to several thousands of hours in the case of powder of conventional thermo-setting resins and conventional thermo-plastic resins.

FIGS. 2, 3 and 4 diagrammatically explain, in a summarized form, the theory of hydrodynamics which forms the essence of the present invention. More particularly, FIG. 2 shows the state where a gas is made to flow through a straight cylindrical pipe 20 having an inner diameter D at a flow rate Q in a turbulent flow region, whereas FIG. 3 shows the state where a cylindrical pipe 22 having an inner diameter D+d is connected to the upstream end of a small-diameter cylindrical pipe 21 on the downstream side having the same inner diameter D as that of the cylindrical pipe 20 in FIG. 2, and a gas is made to flow therethrough at the same flow rate Q.

FIG. 4 is diagrammatic representation of distributions in the diametrical direction of a flow velocity within the cylindrical pipe as measured at point $P_1$ in FIG. 2, at point $P_2$ in FIG. 3, that is, at a point just behind the upstream end of the downstream side small-diameter pipe 21, and at point $P_3$ that is sufficiently remote on the downstream side from the pipe diameter transition point in FIG. 3, respectively. It has been well known that with respect to a flow velocity distribution $V_{D-P1}$ in a diametrical direction on one transverse cross-section $P_1$ of a cylindrical flow path having a fixed inner diameter without abrupt change in a pipe diameter as shown in FIG. 2, a flow velocity is almost zero at a point extremely close to the pipe wall, it increases along a quadratic curve as the measuring point moves away from the pipe wall and the highest flow velocity $V_{max}$ is attained at the crnter of the pipe. Whereas, in the case of disposing a large-diameter cylindrical pipe 22 contiguously to and upstream of a small-diameter cylindrical pipe 21 as shown in FIG. 3, with respect to a flow velocity distribution in a diametrical direction within the pipe as measured at point $P_2$, as shown by a flow velocity distribution curve $V_{D-P2}$ in FIG. 4 there exists a considerable slip velocity $V_{S-P2}$ even at a position extremely close to the pipe wall, but on the contrary, as the measuring point moves up to the center of the tube, though the flow velocity also increases, it does not reach such a high velocity as in the case of FIG. 2. However, in the case of the flow velocity distribution within the small-diameter cylindrical pipe 21 in FIG. 3 also, as the small-diameter cylindrical pipe 21 is elongated and as the measuring point moves to the downstream away from the pipe diameter transition point, the flow velocity distribution in a diametrical direction of the pipe 21 changes gradually from the distribution curve $V_{D-P2}$ towards the distribution curve $V_{D-P3}$ in FIG. 4. Accordingly, if the annular electrode is disposed in the proximity of the upstream end of the downstream side small-diameter cylindrical flow path, the velocity of the gas/powder mixed-phase flow along the surface of the annular electrode can be greatly increased although the average flow rate of the mixed-phase flow is the same in FIGS. 2 and 3, and hence accumulation and deposition of microfine powder particles onto the annular electrode can be effectively prevented. Therefore, in order to effectively practice the present invention, it is essentially important that the annular electrode is disposed in the proximity of the upstream end of the small-diameter cylindrical flow path and also the tip end of the needle electrode 2 to be disposed concentrically with the annular electrode is positioned in the proximity of the upstream end of the small-diameter cylindrical flow path.

The ratio of diameters of the small-diameter cylindrical flow path to the large-diameter cylindrical flow path is varied depending upon the employed operating conditions, and normally the inner diameter of the small-diameter cylindrical pipe could be appropriately selected for the respective applications within the range of 95% to 20% with respect to the inner diameter of the large-diameter cylindrical pipe, depending upon the operating conditions such as a pressure drop through a piping line, processing gas flow rate, processing powder flow rate, etc. through experiments. It is to be noted that in the case where there is a substantial difference between the inner diameter of the large-diameter cylindrical pipe 4 and that of the conduit 7 in FIG. 1, often it is preferable for the purpose of reducing an overall pressure drop across the piping line or the like purpose to provide an expanding tube section 5 in the transient region as shown in FIG. 1. With regard to the transition from the small-diameter cylindrical pipe 21 to the large-diameter cylindrical pipe 22, though there is no need to make any provision if the difference in a pipe diameter is not so large, sometimes it is more preferable to provide a very short transition section if the difference in a pipe diameter is large. In addition, with regard to the downstream section 8 behind the small-diameter cylindrical pipe 6, its configuration could be appropriately selected according to the purpose of use in the subsequent stage. The preferred embodiment illustrated in FIG. 1 corresponds to the case where the present invention is applied to an electrostatic powder painting gun which sprays sufficiently charged powder paint onto a concave surface of a body to be painted and thereby effectively achieves powder painting even in the case of being unable to paint with the conventional electrostatic powder painting gun, and in the illustrated embodiment the downstream section 8 behind the small-diameter cylindrical pipe 6 is formed in an outwardly flared cone shape.

According to the present invention, while the accumulation and deposition of powder particles onto the surface of the annular electrode can be prevented on the basis of the theory of hydrodynamics as described in detail above, in order to more positively realize this performance it is necessary to pay attention to the material of the surface portion of the annular electrode. With regard to the most suitable material for the annular electrode surface portion, electrically conductive fluorine resin is preferable, and in the case where this material is used after sufficient buffing, then a stable performance of the annular electrode can be maintained over a long period of time for every kind of powder such as thermo-plastic powder paint, thermo-setting powder paint, etc. However, in the case of chemically less active powder paint as of polyethylene resin, nylon resin, fluorine resin, etc., metallic materials such as brass, stainless steel, gold, etc. or non-metallic materials such as graphite or the like could be employed as a surface material for the annular electrode.

As described in detail above, while all the problems relating to the annular electrode can be resolved by the application of the theory of hydrodynamics as well as the selection of the material of the electrode surface portion, in order to maintain the excellent performance of the powder charging device having the above-described structure over a long operation period, it is essentially necessary to maintain the state of the tip end of the needle electrode stably clean. Sometimes it may happen that powder particles deposit on the tip end of the needle electrode and intercept the discharge current, resulting in deterioration of the performance of the powder charging device. As one countermeasure for this shortcoming, a gas feed pipe 10 surrounding the needle electrode 2 and opening in the proximity of its tip end is provided as shown in FIG. 1 so that a clean gas flow not containing powder may always exist about the tip end portion of the needle electrode 2 as shown by arrow 11, and thereby the object of maintaining an excellent performance over a long period can be fully achieved. In this provision, the diameter of the opening of the gas feed pipe provided around the tip end portion of the acicular electrode suffices to be about 1.5 mm to 2 mm, and hence the flow rate of the gas flow for cleaning the tip end of the needle electrode represented by arrow 11 normally occupies a fraction of 1/10 or less with respect to the flow rate of the gas/powder mixed-phase flow as used in the conventional electrostatic powder painting gun. Therefore, not only this gas flow can be neglected in respect to the amount of the used gas, but also the influence of this cleaning gas flow upon the overall transport condition of the gas/powder mixed-phase flow can be substantially neglected.

In addition, as different method for stably maintaining the life of the tip end portion of the acicular electrode over a long period of time, sometimes it is effective for maintaining a long life of the acicular electrode 2 to direct the tip end of the needle electrode 2 towards the upstream side of the gas/powder mixed-phase flow and to dispose the tip end at the position opposed to the annular electrode 3 as shown in FIG. 5.

Moreover with regard to matters having close relation to the life of both the needle electrode 2 and the annular electrode 3, it is very effective for efficient operation of a powder charging device and maintenance of its long life to select a current valve of a monopolar ion current from the tip end of the needle electrode 2 towards the annular electrode 3 at an appropriate range, and it is essential to select this current value in such manner that the average current density obtained by dividing the current value of the total current from the tip end of the needle electrode to the annular electrode by the area of the annular electrode 3 which has a length equal to its inner diameter the effective surface area of the annular electrode, may be limited to 8 $\mu A/cm^2$ or less, preferably to 5 $\mu A/cm^2$ or less. If the current value exceed the aforementioned limit, then accumulation of powder, generation of inverse ionization or deposition of powder may possibly occur at the tip end of the needle electrode 2 or on the surface of the annular electrode 3. However, by selecting the current value within the limited range, such harmful phenomena can be effectively prevented over a long period of time.

In the event that a spark discharge should occur from the tip end of the needle electrode 2 towards the annular electrode 3 due to any cause, if the lead wire for applying a voltage to the electrode 2 is long and the electric capacity with respect to the ground associated with the lead wire is large, then the stored energy is abruptly discharged towards the annular electrode 3, so that at that moment deposition of the powder or the like would arise at the tip end of the acicular electrode 2 resulting in a principal cause for impeding a continuous safe operation over a long period of time. Therefore, through not illustrated in FIGS. 1, 5 and 6, it is desirable to make the lead wire for applying a voltage from the power supply 12 to the acicular electrode 2 as short as possible and to insert a guard resistor having a sufficiently high resistance in series to the lead wire just before the needle electrode 2, and from the same reasons it is desirable to form the gas feed pipe 10 for feeding a clean gas to the tip end portion of the needle electrode 2, of an insulator.

In the powder charging device according to the present invention, in the case of polyolefin series resin powder or the like, even if powder particles should somewhat accumulate on the surface of the annular electrode 3, it is possible to lower an electrical resistance of the powder layer accumulated on the electrode surface by regulating a relative humidity of the carrier gas to be maintained higher than a predetermined value, that is, normally at 30–50% or higher, and thereby inverse ionization which may be generated within the accumulated powder layer can be prevented. Therefore, the above-mentioned control for the relative humidity of the carrier gas is sometimes effective for realizing a stable operation of the powder charging device over a long period of time by preventing a harmful current of opposite polarity which flows from the surface of the annular electrode 3 towards the acicular electrode 2.

In the case where color change of powder paint is required in the powder charging device according to the present invention, sometimes a small amount of powder $9_P$ accumulated in a recessed corner portion immediately before the annular electrode 3 as shown in FIG. 6, may being about a problem. In such a case, the problem can be resolved by providing a narrow annular gas injection port 10*a* at a position immediately before the annular electrode 3 and injecting a high pressure gas 11*a* through the injection port to remove the accumulated powder $9_P$ upon the color change of the powder paint.

As described in detail above, since the powder charging device according to the present invention can be effectively operated in a gas/powder mixed-phase flow having a flow rate of the same order as that employed in the conventional electrostatic powder painting gun, the powder charging device can be utilized, for example, as an effective electrostatic powder painting gun by injecting fully charged powder from the tip end of the powder charging device according to the present invention at a moderate velocity and blowing the charged powder onto a concave surface of a body to be painted. In addition, by compactly assembling the powder charging device according to the present invention as a pre-charging device for the conventional electrostatic powder gun, enhancement of a painting efficiency of the conventional electrostatic powder gun having an external electric field can be achieved, and therefore, the powder charging device according to the present invention is an extremely effective device in the electrostatic powder painting technique.

Now, the constructions and disadvantages of the heretofore known powder charging devices which were previously described in a general manner, will be described in greater detail with reference to FIGS. 7, 8 and 9. Thereby the objects and features of the present invention as referred to in the head portion of this specification will become more apparent.

In the basic powder charging device in the prior art illustrated in FIG. 9, an annular electrode 25 is provided in a pipe wall 34 of a flow path for a gas/powder mixed-phase flow 30, an acicular electrode 26 is disposed at the center of the annular electrode 25 as opposed thereto, a D.C. high voltage is applied between these respective electrodes by means of a power supply 32, and the powder is charged by a monopolar ion current having the same polarity as the power supply 32 and flowing between these electrodes.

However, in the case where the operation principle of the above-mentioned basic powder charging device is practically applied to a continuously operating industrial device, as an operation time elapses, particles of powder accumulate on the surface of the annular electrode 25 and form an insulator layer, and the current flowing from the needle electrode 26 towards the annular electrode 25 is impeded by this insulator layer. At the same time, owing to inverse ionization occurring within the insulator layer, a current of opposite polarity begins to flow in the opposite direction from the surface of the annular electrode 25 towards the needle electrode 26, and hence the charge on the powder particles given by the monopolar current flowing from the needle electrode 26 towards the annular electrode 25 is offset by this inverse current. Therefore, it is impossible to construct an industrial device which is required to continuously operate over a long period of time, by employing the basic structure illustrated in FIG. 9. In order to resolve these problems, various methods have been proposed already, and the proposed methods are generally summarized into the following two methods. According to one of the methods, as shown in FIG. 7, a clean gas 31 not containing powder particles fed through a gas feed pipe 29 is blown into an annular chamber 28, and by injecting this clean gas through an annular nozzle 27 provided on the downstream side of the chamber 28 at a high velocity along the surface of the annular electrode 25, a clean gas flow layer is always formed on the surface of the annular electrode 25, whereby the accumulation of powder particles on the surface of the annular electrode 25 can be prevented. It is to be noted that in FIGS. 7 and 8, component parts having common functions to those shown in FIG. 9 are given like reference numerals.

However, in the method illustrated in FIG. 7, the flow rate of the gas not containing powder and injected through the annular nozzle 27 is considerably large, so that a flow velocity 30*a* of a gas/powder mixed-phase flow at the outlet of the powder charging device becomes extremely high, and therefore, in the case where this device is used, for example, as an electrostatic powder gun, there exists a serious shortcoming that the blowout velocity at the tip end of the gun is so fast that the objects for which the electrostatic powder gun is practically available are extremely limited. At the same time, it is substantially very difficult to maintain the prevention of accumulation of microfine powder particles on the surface of the annular electrode 25 over a long period of time through this method, and so, it must be said that this method is short of practicability.

In the other method for preventing accumulation and deposition of microfine powder particles on the surface of the annular electrode 25, as shown in FIG. 8, an annular electrode is formed as a porous electrode 35, a clean gas flow not containing powder particles as shown by arrow 31 is fed through a piping line 29 into an annular chamber formed on the back side of the porous electrode 35 made of a conductor, and by injecting this clean gas through the porous electrode 35, the accumulation and deposition of powder particles on the surface of the annular electrode 35 can be prevented. However, in this method also, for the purpose of preventing accumulation of powder particles on the surface of the electrode 35, it is necessary to inject a clean gas at a flow rate at least one-half of and normally almost equal to the flow rate of the carrier gas necessitated for carrying the powder particles. This will result in an extremely high velocity of the carrier gas for the powder particles at the outlet of the powder charging device according to the present invention, and therefore, similarly to the first method shown in FIG. 7, the applicable scope is extremely limited and the method is short of practicability. At the same time, according to this method, although the powder charging device can withstand against the use for several tens minutes to several hours, it is practically almost impossible to obtain a powder charging device which can withstand against the use continuous use over several tens to several hundreds hours.

In the methods for preventing accumulation and deposition of powder particles onto the surface of the annular electrode by employing a clean auxiliary gas as shown in FIGS. 7 and 8, the difficulty that the gas flow velocity at the outlet of the powder charging device becomes extremely fast, also makes the carrier gas velocity within a device to be connected at the downstream of the powder charging device excessively large, which is apt to cause the occurrence of the problems of deposition of resin and the like, and in such aspects also the methods illustrated in FIGS. 7 and 8 are short of practicability.

Since many changes could be made in the above construction and many apparently widely different embodiments of this invention could be made without departing from the scope thereof, it is intended that all the matter contained in the above description or shown in the accompanying drawings shall be interpreted as illustrative and not in a limiting sense.

What is claimed is:

1. A powder charging device characterized in that said device comprises a large-diameter cylindrical flow path, a small-diameter cylindrical flow path having a smaller inner diameter than the inner diameter of said large-diameter cylindrical flow path, an annular electrode disposed at the upstream end of said small-diameter cylindrical flow path, and a needle electrode disposed concentrically with said annular electrode and axially aligned in opposition to each other, said large-diameter cylindrical flow path being disposed contiguously to said small-diameter cylindrical flow path on the upstream side of the latter, and said two electrodes are adapted to have a voltage applied therebetween and wherein said annular electrode has a uniform inner diameter from its mid-point to its downstream end to provide a subsonic flow therethrough in the velocity range of from 7 to 35 meters per second.

2. A powder charging device as claimed in claim 1, characterized in that said needle electrode is disposed with its tip end directed to the downstream side and further including means for injecting gas around its tip end.

3. A powder charging device as claimed in claim 1, characterized in that said needle electrode is disposed with its tip end directed to the upstream side.

4. A powder charging device as claimed in claim 1, characterized in that said annular electrode has its surface portion formed of conductive fluorine resin.

5. A powder charging device as claimed in claim 1, characterized in that said annular electrode has its average current density over the effective electrode surface area maintained at 8 $\mu A/cm^2$ or less.

6. A powder charging device as claimed in claim 1, characterized in that the relative humidity of the carrier gas flowing along the surface of said annular electrode is maintained at 30% or higher.

7. A powder charging device characterized in that said device comprises a large-diameter cylindrical flow path, a small-diameter cylindrical flow path having a smaller inner diameter than the inner diameter of said large-diameter cylindrical flow path, an annular electrode disposed at the upstream end of said small-diameter cylindrical flow path, and a needle electrode disposed concentrically with said annular electrode as opposed to each other, said large-diameter cylindrical flow path being disposed contiguously to said small-diameter cylindrical flow path on the upstream side of the latter, and said two electrodes are adapted to have a voltage applied therebetween; wherein a tip end portion on the upstream side of said annular electrode is disposed at the position of an annular gas injection port.

8. A powder charging device characterized in that said device comprises a large-diameter cylindrical flow path, a small-diameter cylindrical flow path provided contiguously to the downstream side of said large-diameter cylindrical flow path and having a smaller inner diameter than the inner diameter of said large-diameter cylindrical flow path, a conduit for supplying a gas/-powder mixed-phase flow provided contiguously to the upstream side of said large-diameter cylindrical flow path, an annular electrode disposed at the upstream end of said small-diameter cylindrical flow path, and a needle electrode disposed concentrically with said annular electrode and axially aligned in opposition to each other, said conduit having an inner diameter smaller than the inner diameter of said large-diameter cylindrical flow path and the velocity of a gas/powder mixed-phase flow inside said conduit being maintained at 7 to 35 meters per second in order to supply a uniform flow of a gas/powder mixed-phase flow to said large diameter cylindrical flow path, said annular electrode having an equal inner diameter from the upstream end to the downstream end thereof, the face of said upstream end of said annular electrode being formed normal to the face of said large-diameter cylindrical flow path and means for applying a voltage between said two electroces.

9. A powder charging device characterized in that said device comprises a large-diameter cylindrical flow path, a small-diameter cylindrical flow path provided contiguously to the downstream side of said large-diameter cylindrical flow path and having a smaller inner diameter than the inner diameter of said large-diameter cylindrical flow path, a conduit for supplying a gas/-powder mixed-phase flow provided contiguously to the upstream side of said large-diameter cylindrical flow path, an annular electrode disposed at the upstream end of said small-diameter cylindrical flow path, and a needle electrode disposed concentrically with said annular electrode and axially aligned in opposition to each other, said conduit having an inner diameter smaller than the inner diameter of said large-diameter cylindrical flow path and the velocity of a gas/powder mixed-phase flow inside said conduit being maintained at 7 to 35 meters per second in order to supply a uniform flow of a gas/powder mixed-phase flow to said large-diameter cylindrical flow path, said annular electrode having an equal inner diameter from the upstream end to the downstream end thereof, the face of said upstream end of said annular electrode being formed normal to the face of said large-diameter cylindrical flow path means for applying a voltage between said two electrodes, the tip end portion on the upstream side of said annular electrode being disposed at the position of an annular gas injection port.

* * * * *

UNITED STATES PATENT AND TRADEMARK OFFICE

CERTIFICATE OF CORRECTION

PATENT NO. : 4 227 652

DATED : October 14, 1980

INVENTOR(S) : Tsutomu Itoh

It is certified that error appears in the above—identified patent and that said Letters Patent is hereby corrected as shown below:

Column 5, line 63:

"through" should be --though--

Column 6, line 26:

"being" should be --bring--

Column 8, line 10:

After "tens" add --of--

Column 10, line 7:

"electroces" should be --electrodes--

Signed and Sealed this

*Fourth* Day of *August 1981*

[SEAL]

*Attest:*

GERALD J. MOSSINGHOFF

*Attesting Officer*

*Commissioner of Patents and Trademarks*